US011660733B1

(12) United States Patent
Hu

(10) Patent No.: US 11,660,733 B1
(45) Date of Patent: May 30, 2023

(54) ADJUSTABLE TORQUE WRENCH FOR NARROW SPACES

(71) Applicant: Nan Hu, Irvine, CA (US)

(72) Inventor: Nan Hu, Beijing (CN)

(73) Assignee: Nan HU, Irvine, CA (US)

( * ) Notice: Subject to any disclaimer, the term of this patent is extended or adjusted under 35 U.S.C. 154(b) by 0 days.

(21) Appl. No.: 17/983,419

(22) Filed: Dec. 19, 2022

(51) Int. Cl.
*B25B 13/48* (2006.01)
*B25B 23/142* (2006.01)

(52) U.S. Cl.
CPC ..... *B25B 13/481* (2013.01); *B25B 23/1427* (2013.01)

(58) Field of Classification Search
CPC .. B25B 13/481; B25B 23/142; B25B 23/1427
See application file for complete search history.

(56) References Cited

U.S. PATENT DOCUMENTS 2,789,454 A * 4/1957 Woods ..... B25B 23/1427 81/481
6,162,053 A * 12/2000 Hollander ..... A61C 8/0089 433/141
9,505,110 B2 * 11/2016 Hsieh ..... B25B 23/1422
9,527,194 B2 * 12/2016 Kerboul ..... B25B 23/1427
10,882,164 B2 * 1/2021 Perndl ..... B25B 23/141
11,130,216 B2 * 9/2021 Hermansen ..... B25B 23/1427
11,173,582 B2 * 11/2021 Ruetschi ..... B25B 13/462
11,260,508 B2 * 3/2022 Huang ..... B25B 23/0035
11,298,807 B2 * 4/2022 Poonawalla ..... B25B 23/1427
2021/0060743 A1 * 3/2021 Hu ..... B25B 23/1427

FOREIGN PATENT DOCUMENTS

CN 2493358 Y 5/2002
CN 105437136 A 3/2016
CN 210550728 U 5/2020
CN 112338849 A 2/2021
CN 212553582 U 2/2021

* cited by examiner

*Primary Examiner* — David B. Thomas
(74) *Attorney, Agent, or Firm* — Yu Gang

(57) ABSTRACT

Disclosed is a torque-adjustable wrench for a narrow space. The present disclosure relates to the technical field of assembly tools. The wrench comprises an elongated upper cover plate and an elongated lower cover plate, the space between the upper cover plate and the lower cover plate forms a mounting space, one end of the mounting space is provided with a screw pre-tightening mechanism, and the other end of the mounting space is provided with an adjustable screw locking mechanism. During use of the wrench, first, the screw pre-tightening mechanism is used to pre-tighten a screw to be assembled, and then the adjustable screw locking mechanism is used to perform locking operation on the pre-tightened screw. By means of the wrench, the mounting and dismounting of a screw in a narrow space can be conveniently achieved.

5 Claims, 4 Drawing Sheets

ADJUSTABLE TORQUE WRENCH FOR NARROW SPACES

CROSS-REFERENCE TO RELATED APPLICATION(S)

The disclosure claims priority to Chinese Patent Application No. 202110990725.X, filed on Aug. 26, 2021 and entitled "Torque-adjustable Wrench for Narrow Space", the disclosure of which is hereby incorporated by reference in its entirety.

TECHNICAL FIELD

The present disclosure relates to the technical field of assembly tools, and in particular, to a torque-adjustable wrench for a narrow space.

BACKGROUND

A traditional wrench is to make a wrench head fasten or dismount a screw by rotating a handle, and such a traditional wrench can be arbitrarily rotated in an open space for use. However, if a screw in a relatively narrow space position is to be fastened, a handle cannot be spread for rotation and use, which brings inconvenience to many operations urgently requiring mounting or dismounting of a screw.

SUMMARY

The technical problem to be solved by some embodiments of the present disclosure is to provide a torque-adjustable wrench capable of conveniently achieving mounting and dismounting of screws in a narrow space.

In order to solve the technical problem, the technical solution adopted by some embodiments of the present disclosure is: a torque-adjustable wrench for a narrow space, including an elongated upper cover plate and an elongated lower cover plate, wherein a space between the upper cover plate and the lower cover plate forms a mounting space, a first end of the mounting space is provided with a screw pre-tightening mechanism, and a second end of the mounting space is provided with an adjustable screw locking mechanism.

In some embodiments, a first boss extending downwards is formed in a middle of the upper cover plate, an adjustment wheel mounting upper-half groove is formed on a right side of the first boss, and an upper side of the adjustment wheel mounting upper-half groove extends through an upper surface of the upper cover plate, so that when an adjustment wheel is mounted in the adjustment wheel mounting upper-half groove, a part of the adjustment wheel is exposed; and a first mounting plate extending outwards is formed at a left end of the lower cover plate, and a first connecting gear mounting hole is formed on the first mounting plate.

In some embodiments, a second boss extending upwards is formed in a middle of the lower cover plate, an adjustment wheel mounting lower-half groove corresponding to the adjustment wheel mounting upper-half groove is formed on a right side of the second boss, and a lower side of the adjustment wheel mounting lower-half groove extends through a lower surface of the lower cover plate, so that when the adjustment wheel is mounted in the adjustment wheel mounting lower-half groove, a part of the adjustment wheel is exposed; a second mounting plate extending outwards is formed at a left end of the lower cover plate, and a second connecting gear mounting hole is formed on the second mounting plate at a position corresponding to the first connecting gear mounting hole; a large gear mounting column is formed on the lower cover plate and disposed between the second boss and the second mounting plate, a first pinion mounting hole is formed on the second mounting plate between the large gear mounting column and the second connecting gear mounting hole; and a pointer elongated hole and a rotating arm connecting column are sequentially formed from left to right on the lower cover plate at the right side of the adjustment wheel mounting lower-half groove.

In some embodiments, the screw pre-tightening mechanism includes a large gear, the large gear is rotatably sleeved onto the large gear mounting column, mounting columns at two ends of a pinion are respectively inserted into the first pinion mounting hole and the second pinion mounting hole, and the pinion is engaged with the large gear; a first end of the connecting gear is located in the first connecting gear mounting hole, a second end of the connecting gear is located in the second connecting gear mounting hole, the connecting gear is engaged with the pinion; and a first insertion hole is formed on an upper end of the connecting gear, and a first hexagon head is inserted into the first insertion hole.

In some embodiments, the adjustable screw locking mechanism includes the adjustment wheel, the adjustment wheel is located in the space enclosed by the adjustment wheel mounting upper-half groove and the adjustment wheel mounting lower-half groove, and the adjustment wheel is able to rotate relative to the upper cover plate; a U-shaped clamping piece at the right side of the adjustment wheel is fixed on the lower cover plate, an inner threaded hole is formed at an axis of the adjustment wheel, a through hole is formed on the clamping piece opposite the inner threaded hole; a first end of a screw rod passes through the through hole and is in threaded connection with the inner threaded hole; pointer positioning blocks are formed in a middle of the screw rod, a pointer positioning groove is formed on the pointer positioning blocks, an upper end of a pointer is inserted into the pointer positioning groove, and a lower end of the pointer is inserted into the pointer elongated hole; a spring is sleeved on the screw rod at the right side of the pointer positioning groove, a first end of a push rod is snap-fitted into an opening of the clamping piece, so that the right ends of the screw rod and the spring are in contact with a left end face of the push rod, a first end of the rotating arm is sleeved on the rotating arm connecting column, and the rotating arm is able to rotate around the rotating arm connecting column; a push rod insertion slot is formed at the left end of the rotating arm, a second end of the push rod is located outside the clamping piece, and this second end is inserted into the push rod insertion slot; and a second insertion hole is formed at a second end of the rotating arm, and a second hexagon head is inserted into the second insertion hole.

In some embodiments, the adjustable screw locking mechanism further includes a set screw, a set screw threaded hole is formed on the lower cover plate, the set screw is located in the set screw threaded hole, an upper end of the set screw is able to contact the adjustment wheel, and the adjustment wheel is able to be locked by adjusting the set screw.

Beneficial effects produced by using the technical solutions lie in: the torque-adjustable wrench is flat as a whole, and when it is necessary to fasten a screw, firstly the screw is pre-tightened by using the first hexagon head in the screw pre-tightening mechanism; in the pre-tightening process, the large gear is manually rotated, the large gear transmits power to the connecting gear by the pinion, and the connecting gear drives, by the first hexagon head, the screw to rotate, thereby completing pre-tightening of the screw; thereafter, the maximum torque is adjusted by the adjustable screw locking mechanism, and during adjustment, the adjustment wheel is manually rotated, the adjustment wheel drives the screw rod and the pointer to move, the screw rod compresses the spring, the spring presses against the push rod, and the push rod pushes against the rotating arm (adjusting the compression amount of the spring by adjusting the screw rod, thereby achieving adjustment of the maximum torque, and completing setting of the maximum torque); the pointer slides in the pointer elongated hole of the lower cover plate, the pointer stops at the position of a torque value displayed by the scale, the set screw is screwed to lock the adjustment wheel, so as to fix the torque; if other torque values are to be adjusted, the set screw needs to be unscrewed first, then the adjustment wheel is rotated while observing the position of the pointer, so as to adjust the maximum torque; and after the maximum torque is set, the second hexagon head at the other side is used to be assembled with the screw in the pre-tightened state, the second hexagon head at the other side fixes the maximum torque; and the wrench is manually rotated until the rotating arm forms 90 degrees with the upper and lower cover plates, the fastening of the screw is completed, that is, the assembling torque of the screw reaches a required torque value. The wrench is convenient to use, and can conveniently achieve the mounting and dismounting of screws in a narrow space.

BRIEF DESCRIPTION OF THE DRAWINGS

Hereinafter, some embodiments of the present disclosure are further described in detail with reference to the accompanying drawings and specific embodiments.

in which: 1, Second hexagon head; 2, Rotating arm; 3, Clamping piece; 4, Lower cover plate; 5, Upper cover plate; 6, Large gear; 7, Pinion; 8, First hexagon head; 9, Cross screw; 10, Slotted screw; 11, Push rod; 12, Spring; 13, Adjustment wheel; 14, Screw rod; 15, Set screw; 16, Pointer; 17, Connecting gear; 18, First boss; 19, First connecting gear mounting hole; 20, Second boss; 21, Adjustment wheel mounting lower-half groove; 22, Second connecting gear mounting hole; 23, Large gear mounting column; 24, First pinion mounting hole; 25, Pointer elongated hole; 26, Rotating arm connecting column; 27, Pointer positioning block; 28, Rotating arm mounting hole; 29, Large gear mounting hole.

DETAILED DESCRIPTION OF THE EMBODIMENTS

Hereinafter, the technical solutions in the embodiments of the present disclosure will be described clearly and completely with reference to the accompanying drawings of the embodiments of the present disclosure. Obviously, the embodiments as described are only some of the embodiments of the present disclosure, and are not all of the embodiments. All other embodiments obtained by a person of ordinary skill in the art on the basis of the embodiments of the present disclosure without any inventive effort shall all fall within the scope of protection of the present disclosure.

In the following description, numerous specific details are illustrated to facilitate thorough understanding of the present disclosure; however, the present disclosure may also be implemented in other manners different from those described herein. A person skilled in the art could make similar generalizations without departing from the scope of the present disclosure. Therefore, the present disclosure is not limited to the specific embodiments disclosed below.

Figure 1:
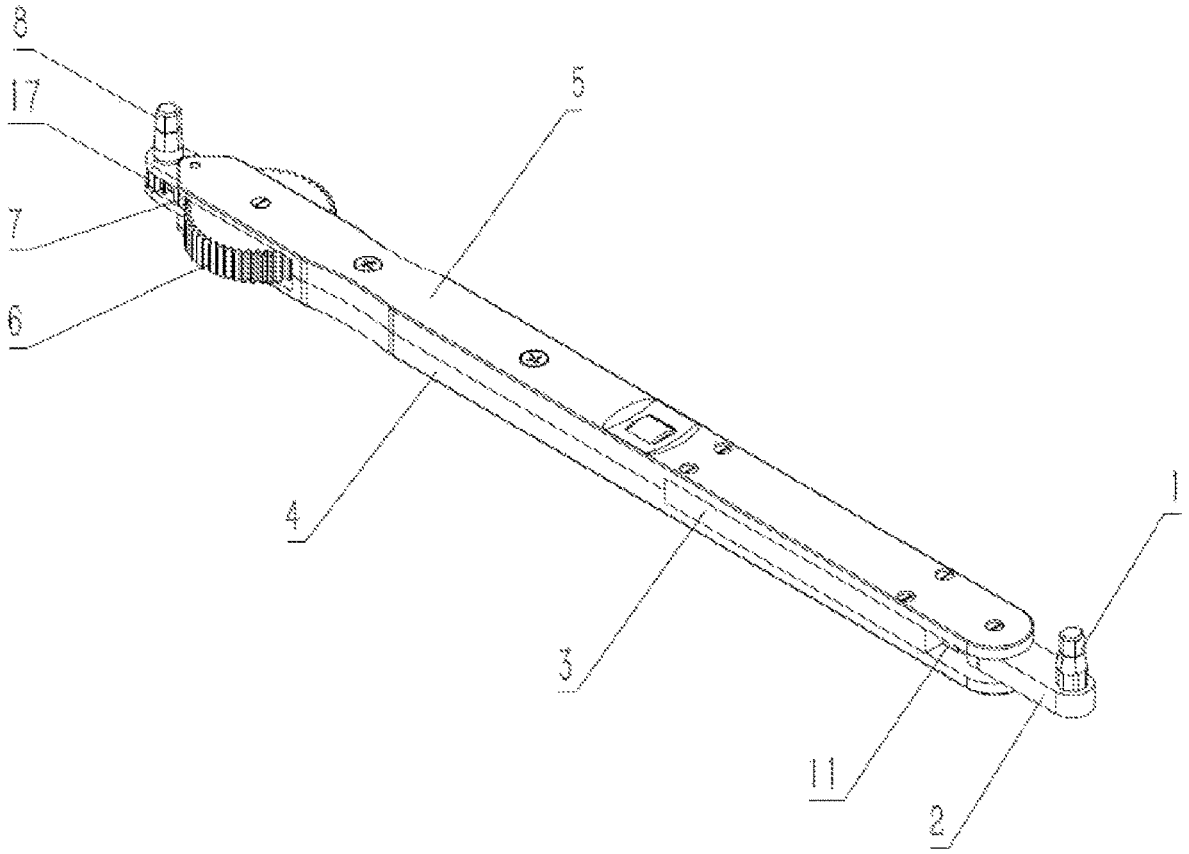
FIG. 1 is a schematic diagram of a stereoscopic structure of a wrench according to embodiments of the present disclosure.
Figure 2:
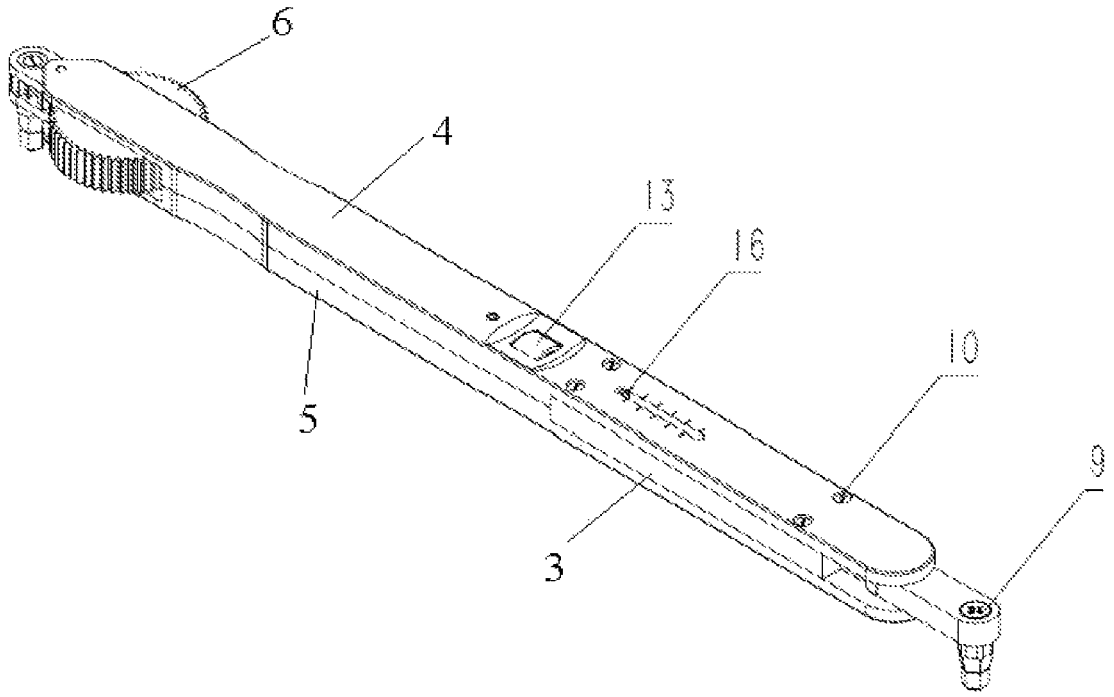
FIG. 2 is a schematic diagram of a stereoscopic structure of a wrench according to embodiments of the present disclosure.
Figure 3:
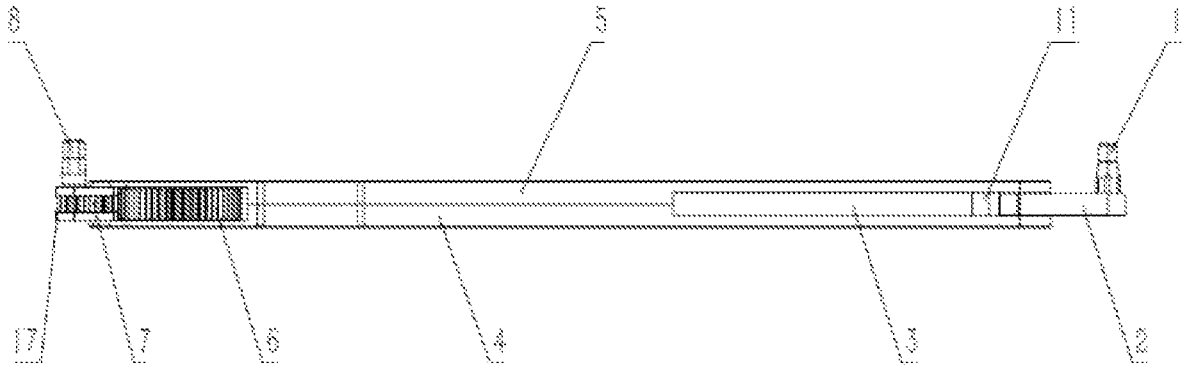
FIG. 3 is a schematic diagram of a side-viewing structure of a wrench according to embodiments of the present disclosure.
Figure 4:
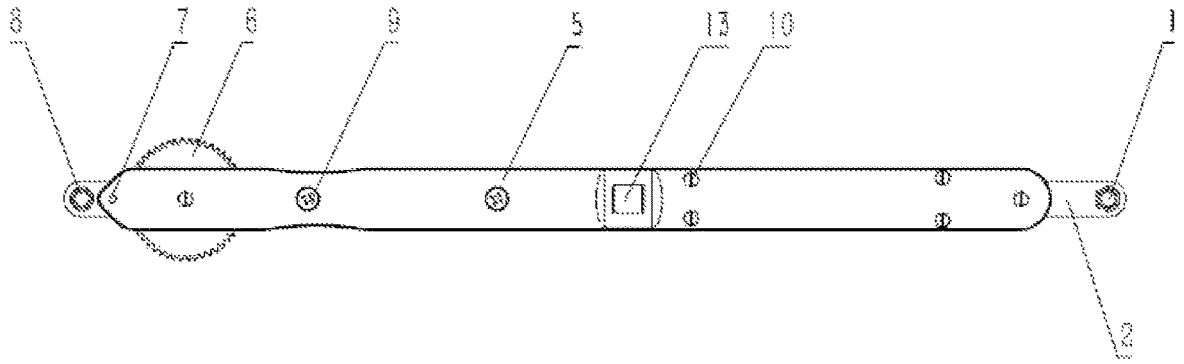
FIG. 4 is a schematic diagram of a top-viewing structure of a wrench according to embodiments of the present disclosure.

As shown in FIGS. 1-2, embodiments of the present disclosure disclose a torque-adjustable wrench for a narrow space, wherein the manufacturing material of the wrench is a metal material as a whole, and the wrench includes an elongated upper cover plate 5 and an elongated lower cover plate 4, the space between the upper cover plate 5 and the lower cover plate 4 forms a mounting space, a first end of the mounting space is provided with a screw pre-tightening mechanism, and a second end of the mounting space is provided with an adjustable screw locking mechanism. Under the effect of the screw pre-tightening mechanism and the adjustable screw locking mechanism, mounting of a screw in a narrow space can be completed.

Figure 5:
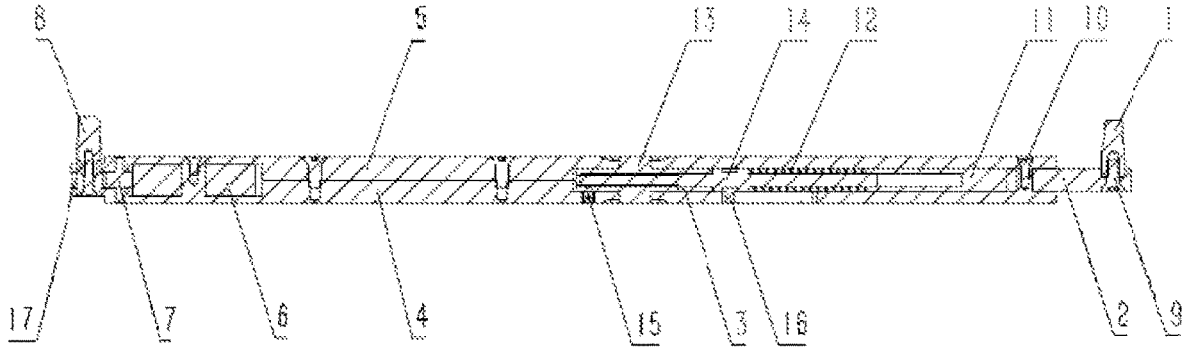
FIG. 5 is a schematic diagram of a sectional structure of a wrench according to embodiments of the present disclosure.
Figure 6:
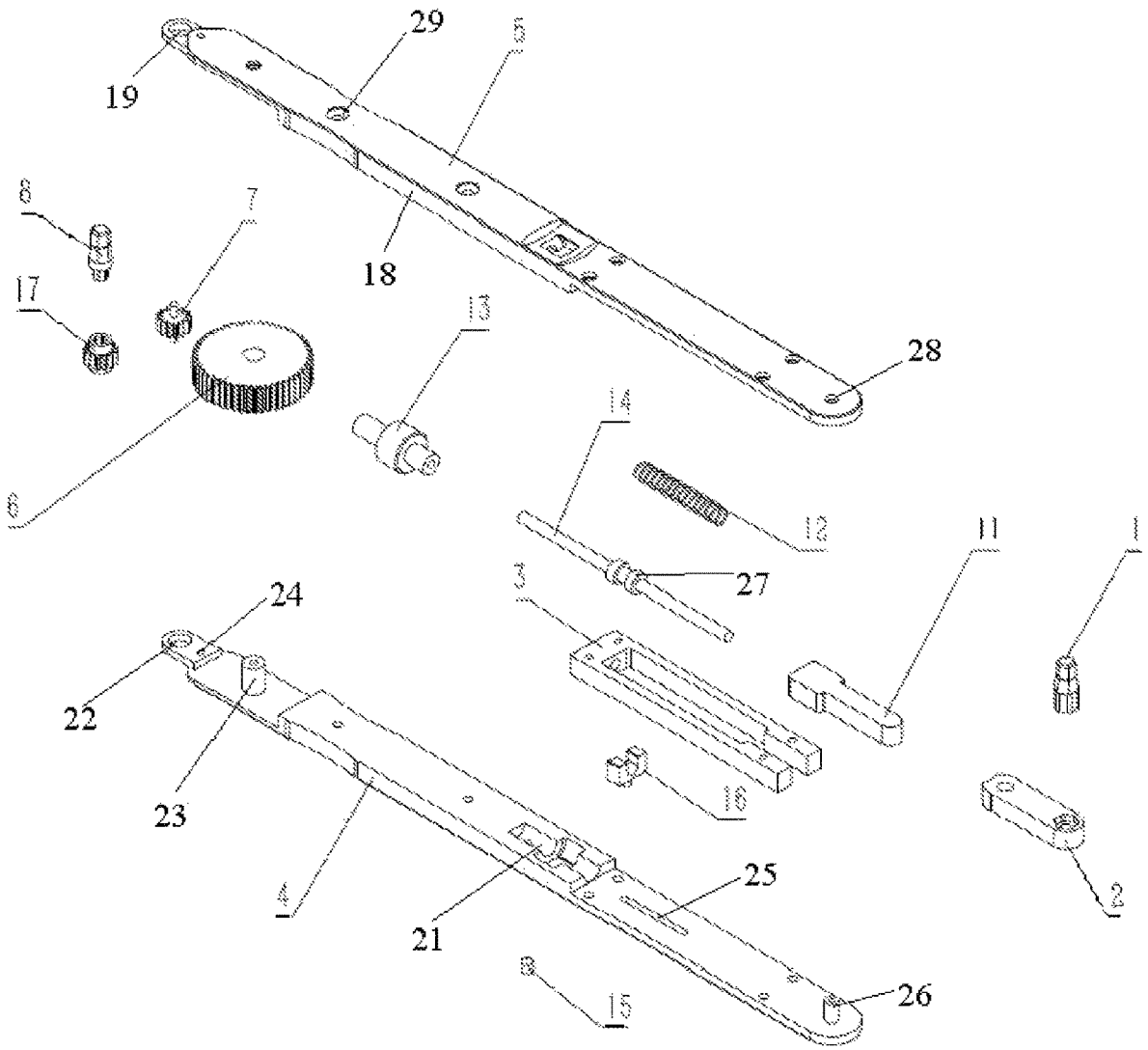
FIG. 6 is a schematic diagram of an exploded structure of a wrench according to embodiments of the present disclosure.

As shown in FIGS. 3-6, a first boss 18 extending downwards is formed in the middle of the upper cover plate 5, the first boss 18 is of a rectangular parallelepiped structure as a whole, an adjustment wheel mounting upper-half groove is formed on the right side of the first boss 18 (the adjustment wheel mounting upper-half groove is shielded by the upper cover plate 5 in FIG. 6), and an upper side of the adjustment wheel mounting upper-half groove extends through an upper surface of the upper cover plate 5, so that when an adjustment wheel 13 is mounted in the adjustment wheel mounting upper-half groove, a part of the adjustment wheel is exposed; and during use, a finger can contact an exposed part of the adjustment wheel 13, and for ease of operation, anti-slip patterns can also be provided on the adjustment wheel 13. A first mounting plate extending outwards is formed at a left end of the upper cover plate 5, the thickness of the first mounting plate is less than the thickness of the upper cover plate 5, and the width of the first mounting plate is less than the width of the upper cover plate 5, thereby facilitating the insertion of the whole wrench into a narrow space. In addition, a first connecting gear mounting hole 19 is formed on the first mounting plate, for conveniently completing the mounting of a connecting gear 17.

As shown in FIGS. 3-6, a second boss 20 extending upwards is formed in a middle of the lower cover plate 4, the second boss 20 is of a rectangular parallelepiped structure as a whole, an adjustment wheel mounting lower-half groove 21 is formed on a right side of the second boss 20, the adjustment wheel mounting lower-half groove 21 corresponds to the adjustment wheel mounting upper-half groove, a space enclosed by the adjustment wheel mounting upper-half groove and the adjustment wheel mounting lower-half groove 21 is adapted to the adjustment wheel, and a lower side of the adjustment wheel mounting lower-half groove 21 extends through a lower surface of the lower cover plate 4, so that when the adjustment wheel 13 is mounted in the adjustment wheel mounting lower-half groove 21, a part of the adjustment wheel is exposed. A second mounting plate extending outwards is formed at a left end of the lower cover plate 4, and a second connecting gear mounting hole 22 is formed on the second mounting plate, the second connecting gear mounting hole 22 corresponds to the first connecting gear mounting hole 19. The second connecting gear mounting hole 22 is used for cooperating with the first connecting gear mounting hole to achieve a function of mounting the connecting gear, the thickness of the second mounting plate is less than the thickness of the lower cover plate 4, and the width of the second mounting plate is less than the width of the lower cover plate 4, thereby facilitating the insertion of the whole wrench into a narrow space for use. A large gear mounting column 23 is formed on the lower cover plate 4 and the large gear mounting column 23 is disposed between the second boss 20 and the second mounting plate, a first pinion mounting hole 24 is formed on the second mounting plate between the large gear mounting column 23 and the second connecting gear mounting hole 22; and a pointer elongated hole 25 and a rotating arm connecting column 26 are sequentially formed from left to right on the lower cover plate at the right side of the adjustment wheel mounting lower-half groove 21.

As shown in FIG. 6, a large gear mounting hole 29 is formed on the upper cover plate 5, the large gear mounting hole 29 corresponds to the large gear mounting column 23, and the large gear mounting column 23, the large gear mounting hole 29 and screws, etc. cooperate with one another to complete the mounting of a large gear; a second pinion mounting hole corresponding to the first pinion mounting hole 24 is formed on the upper cover plate 5, and the first pinion mounting hole 24 and the second pinion mounting hole cooperate with each other to complete the mounting of a pinion; and a rotating arm mounting hole 28 corresponding to the rotating arm connecting column 26 is formed on the upper cover plate 5, and a rotating arm is able to rotate around the rotating arm connecting column 26.

In some embodiments, as shown in FIGS. 5-6, the screw pre-tightening mechanism includes the large gear 6, the large gear 6 is rotatably sleeved onto the large gear mounting column 23, mounting columns at two ends of the pinion 7 are respectively inserted into the first pinion mounting hole 24 and the second pinion mounting hole, and the pinion 7 is engaged with the large gear 6. A first end of the connecting gear 17 is located in the first connecting gear mounting hole 19, a second end of the connecting gear 17 is located in the second connecting gear mounting hole 22, the connecting gear 17 is engaged with the pinion 7; a first insertion hole is formed on an upper end of the connecting gear 17, and a first hexagon head 8 is inserted into the first insertion hole. It should be noted that the first hexagon head 8 can be replaced according to actual needs, for mounting screws of different sizes. In addition, components in the screw pre-tightening mechanism are generally metal members, for improving the service life and working strength.

In some embodiments, as shown in FIGS. 5-6, the adjustable screw locking mechanism includes the adjustment wheel 13, the adjustment wheel 13 is located in the space enclosed by the adjustment wheel mounting upper-half groove and the adjustment wheel mounting lower-half groove 21, and the adjustment wheel 13 is configured to rotate relative to the upper cover plate 5. A U-shaped clamping piece 3 is fixed on the lower cover plate 4, and the clamping piece 3 is disposed at the right side of the adjustment wheel 13, an inner threaded hole is formed at an axis of the adjustment wheel 13, and a through hole is formed on the clamping piece 3 opposite the inner threaded hole. A first end of a screw rod 14 passes through the through hole and is in threaded connection with the inner threaded hole, and outer threads fitting inner threads in the adjustment wheel 13 are formed on the screw rod. At least one pointer positioning block 27 is formed in a middle of the screw rod 14, a pointer positioning groove is formed on the pointer positioning block 27, an upper end of a pointer 16 is inserted into the pointer positioning groove, and a lower end of the pointer 16 is inserted into the pointer elongated hole 25, and the pointer 16 is able to move along a length direction of the wrench under the driving of the screw rod 14. A spring 12 is sleeved on the screw rod 14 at the right side of the pointer positioning groove, a first end of a push rod 11 is snap-fitted into an opening of the clamping piece 3, so that the right ends of the screw rod 14 and the spring 12 are in contact with a left end face of the push rod 11, a first end of the rotating arm 2 is sleeved on the rotating arm connecting column 26, and the rotating arm 2 is able to rotate around the rotating arm connecting column 26. A push rod insertion slot is formed at the left end of the rotating arm 2, a second end of the push rod 11 is located outside the clamping piece 3, and this second end is inserted into the push rod insertion slot; and a second insertion hole is formed at a second end of the rotating arm 2, and a second hexagon head 1 is inserted into the second insertion hole. It should be noted that the second hexagon head 1 can be replaced according to actual needs (generally having the same size as the first hexagon head 8), for mounting screws of different sizes. In addition, components in the adjustable screw pre-tightening mechanism are generally metal members, for improving the service life and working strength.

As shown in FIGS. 5-6, the adjustable screw locking mechanism further includes a set screw 15, a set screw threaded hole is formed on the lower cover plate 4, the set screw 15 is located in the set screw threaded hole, an upper end of the set screw 15 is able to contact the adjustment wheel 13, and the adjustment wheel 13 is able to be locked by adjusting the set screw 15. In some embodiments, as shown in FIG. 2, a torque value scale line is formed on a lower surface of the lower cover plate 4 outside the pointer elongated hole 25, for marking the maximum adjustable torque of the wrench.

In addition, it should be noted that as shown in FIGS. 1-2, in general, the upper cover plate 5 and the lower cover plate 4 are fixedly connected together by using screw holes and screws that cooperate with one another, so that after connection, the strength between the upper and lower cover plates is higher. The diameter of the large gear 6 is greater than the widths of the upper cover plate 5 and the lower cover plate 4, so as to facilitate manual operation of the large gear 6; and in general, the width of the upper cover plate 5 is equal to the width of the lower cover plate 4.

A use method: a whole structure of the torque-adjustable wrench is flat, and when it is necessary to fasten a screw, first the screw is pre-tightened by using the first hexagon head 8 in the screw pre-tightening mechanism; in the pre-tightening process, the large gear 6 is manually rotated, the large gear 6 transmits power to the connecting gear 17 by the pinion 7, and the connecting gear 17 drives, by the first hexagon head 8, the screw to rotate, thereby completing pre-tightening of the screw; thereafter, the maximum torque is adjusted by the adjustable screw locking mechanism, and during adjustment, the adjustment wheel 13 is manually rotated, the adjustment wheel 13 drives the screw rod 14 and the pointer 16 to move, the screw rod 14 compresses the spring 12, the spring 12 presses against the push rod 11, and the push rod 11 pushes against the rotating arm 2 (adjusting the compression amount of the spring 12 by adjusting the screw rod 14, thereby achieving adjustment of the maximum torque, and completing setting of the maximum torque); the pointer 16 slides in the pointer elongated hole 25 of the lower cover plate 4, the pointer 16 stops at the position of a torque value displayed by the scale, the set screw 15 is screwed to lock the adjustment wheel 13, so as to fix the torque; if other torque values are to be adjusted, the set screw 15 needs to be unscrewed first, then the adjustment wheel 13 is rotated while observing the position of the pointer 16, so as to adjust the maximum torque; and after the maximum torque is set, the second hexagon head 1 at the other side is used to be assembled with the screw in the pre-tightened state, the second hexagon head 1 at the other side fixes the maximum torque; and the wrench is manually rotated until the rotating arm 2 forms 90 degrees with the upper and lower cover plates, the fastening of the screw is completed, that is, the assembling torque of the screw reaches a required torque value.

What is claimed is:

1. A torque-adjustable wrench for a narrow space, comprising:

an elongated upper cover plate (5);

an elongated lower cover plate (4), wherein a space between the upper cover plate (5) and the lower cover plate (4) forms a mounting space;

a screw pre-tightening mechanism; and an adjustable screw locking mechanism, a first end of the mounting space is provided with the screw pre-tightening mechanism, and a second end of the mounting space is provided with the adjustable screw locking mechanism;

wherein a first boss (18) extending downwards is formed in a middle of the upper cover plate (5), an adjustment wheel mounting upper-half groove is formed on a right side of the first boss (18), and an upper side of the adjustment wheel mounting upper-half groove extends through an upper surface of the upper cover plate (5), so that when an adjustment wheel (13) is mounted in the adjustment wheel mounting upper-half groove, a part of the adjustment wheel is exposed; and a first mounting plate extending outwards is formed at a left end of the lower cover plate (5), and a first connecting gear mounting hole (19) is formed on the first mounting plate;

wherein a second boss (20) extending upwards is formed in a middle of the lower cover plate (4), an adjustment wheel mounting lower-half groove (21) corresponding to the adjustment wheel mounting upper-half groove is formed on a right side of the second boss (20), and a lower side of the adjustment wheel mounting lower-half groove (21) extends through a lower surface of the lower cover plate (4), so that when the adjustment wheel (13) is mounted in the adjustment wheel mounting lower-half groove (21), a part of the adjustment wheel is exposed; a second mounting plate extending outwards is formed at a left end of the lower cover plate (4), and a second connecting gear mounting hole (22) corresponding to the first connecting gear mounting hole (19) is formed on the second mounting plate; a large gear mounting column (23) between the second boss (20) and the second mounting plate is formed on the lower cover plate (4), a first pinion mounting hole (24) is formed on the second mounting plate between the large gear mounting column (23) and the second connecting gear mounting hole (22); and a pointer elongated hole (25) and a rotating arm connecting column (26) are sequentially formed from left to right on the lower cover plate, the pointer elongated hole (25) and a rotating arm connecting column (26) are disposed at the right side of the adjustment wheel mounting lower-half groove (21);

wherein a large gear mounting hole, a second pinion mounting hole and a rotating arm mounting hole are formed on the upper cover plate (5), wherein the large gear mounting hole corresponds to the large gear mounting column (23), the second pinion mounting hole corresponds to the first pinion mounting hole (24) and the rotating arm mounting hole corresponds to the rotating arm connecting column (26);

wherein the screw pre-tightening mechanism comprises a large gear (6), the large gear (6) is rotatably sleeved onto the large gear mounting column (23), mounting columns at two ends of a pinion (7) are respectively inserted into the first pinion mounting hole (24) and the second pinion mounting hole, and the pinion (7) is engaged with the large gear (6); a first end of the connecting gear (17) is located in the first connecting gear mounting hole (19), a second end of the connecting gear (17) is located in the second connecting gear mounting hole (22), the connecting gear (17) is engaged with the pinion (7); and a first insertion hole is formed on an upper end of the connecting gear (17), and a first hexagon head (8) is inserted into the first insertion hole;

wherein the adjustable screw locking mechanism comprises the adjustment wheel (13), the adjustment wheel (13) is located in the space enclosed by the adjustment wheel mounting upper-half groove and the adjustment wheel mounting lower-half groove (21), and the adjustment wheel (13) is able to rotate relative to the upper cover plate (5); a U-shaped clamping piece (3) is fixed on the lower cover plate (4) at a right side of the adjustment wheel (13), an inner threaded hole is formed at an axis of the adjustment wheel (13), a through hole is formed on the clamping piece (3) opposite the inner threaded hole; one end of a screw rod (14) passes through the through hole and is in threaded connection with the inner threaded hole; pointer positioning blocks (27) are formed in a middle of the screw rod (14), a pointer positioning groove is formed on the pointer positioning blocks (27), an upper end of a pointer (16) is inserted into the pointer positioning groove, and a lower end of the pointer (16) is inserted into the pointer elongated hole (25); a spring (12) is sleeved on the screw rod (14) at the right side of the pointer positioning groove, a first end of a push rod (11) is snap-fitted into an opening of the clamping piece (3), so that the right ends of the screw rod (14) and the spring (12) are in contact with a left end face of the push rod (11), a first end of a rotating arm (2) is sleeved on the rotating arm connecting column (26), and the rotating arm (2) is able to rotate around the rotating arm connecting column (26); a push rod insertion slot is formed at the left end of the rotating arm (2), a second end of the push rod (11) is located outside the clamping piece (3), and this end is inserted into the push rod insertion slot; and a second insertion hole is formed at a second end of the rotating arm (2), and a second hexagon head (1) is inserted into the second insertion hole.

2. The torque-adjustable wrench for the narrow space according to claim 1, wherein the adjustable screw locking mechanism further comprises a set screw (15), a set screw threaded hole is formed on the lower cover plate (4), the set screw (15) is located in the set screw threaded hole, an upper end of the set screw (15) is configured to contact the adjustment wheel (13), and the adjustment wheel (13) is able to be locked by adjusting the set screw (15).

3. The torque-adjustable wrench for the narrow space according to claim 1, wherein a torque value scale line is formed on a lower surface of the lower cover plate (4) outside the pointer elongated hole (25), for marking a maximum adjustable torque of the wrench.

4. The torque-adjustable wrench for the narrow space according to claim 1, wherein the upper cover plate (5) and the lower cover plate (4) are fixedly connected together by using screw holes and screws that cooperate with one another.

5. The torque-adjustable wrench for the narrow space according to claim 1, wherein a diameter of the large gear (6) is greater than widths of the upper cover plate (5) and the lower cover plate (4); and the upper cover plate (5) and the lower cover plate (4) have the same width.

* * * * *